US005490787A

United States Patent [19]

Bowman et al.

[11] Patent Number: 5,490,787

[45] Date of Patent: Feb. 13, 1996

[54] ELECTRICAL CONNECTOR WITH INTEGRAL SUPPORTING STRUCTURE

[75] Inventors: Michael E. Bowman, Lebanon; Robert S. Correll, Jr., Harrisburg; Donald E. Dellinger, Hellam; Dennis L. Kemmick, Columbia; Timothy L. Kocher, Camp Hill, all of Pa.

[73] Assignee: The Whitaker Corporation, Wilmington, Del.

[21] Appl. No.: 297,335

[22] Filed: Aug. 29, 1994

[51] Int. Cl.[6] ..... H01R 23/70

[52] U.S. Cl. ..... 439/79

[58] Field of Search ..... 439/79

[56] References Cited

U.S. PATENT DOCUMENTS

| | | | |
|---|---|---|---|
| 4,410,230 | 10/1983 | SanMiguel | 439/682 |
| 4,425,015 | 1/1984 | Rizzo | 439/79 |
| 4,550,962 | 11/1985 | Czeschka | 439/78 |
| 4,749,357 | 6/1988 | Foley | 439/80 |
| 4,955,819 | 9/1990 | Harting et al. | 439/79 |
| 5,114,355 | 5/1992 | Kimmel et al. | 439/101 |
| 5,158,471 | 10/1992 | Fedder et al. | 439/80 |
| 5,199,886 | 4/1993 | Patterson | 439/79 |
| 5,252,080 | 10/1993 | Pesson | 439/79 |
| 5,259,773 | 11/1993 | Champion et al. | 439/108 |
| 5,282,752 | 2/1994 | Doutrich et al. | 439/79 |

*Primary Examiner*—Gary F. Paumen

[57] ABSTRACT

An electrical connector (10) is disclosed having a one piece housing (12), a plurality of cavities (18,20,22,24) in the housing, arranged in two vertical stacks (14,16) of four cavities each, and a contact (26,28,30,32) in each cavity. The cavities in each stack are separated by thin walls (48,50,52) of the housing. Each of the contacts has a contact end (68) for mating with a mating connector, and a tail (78) that exits from the contact at a right angle to the mounting surface (36) of the connector. Some of the contacts (28,30,32) have support members (94,96,98,100,102,104) that extend from the contact to engage the floor (53) of the cavity while the upper surface of the contact is in engagement with the ceiling (51) of the cavity. There is a bearing structure established from the tails (78) through the support members and the thin walls (48,50,52) to the top surface (34) of the connector housing. This permits installation of the connector (10) to a circuit board (112) by applying an insertion force directly to the top surface of the housing.

14 Claims, 6 Drawing Sheets

ELECTRICAL CONNECTOR WITH INTEGRAL SUPPORTING STRUCTURE

The present invention is related to electrical connectors of the type that are mounted to a circuit board with their contact leads exiting the connector at a right angle and extending through holes in the board, and more particularly to such connectors that are intended to be assembled to the board by aligning the leads with the holes and then applying sufficient force to the top of the connector housing to insert the press fit leads fully into the holes.

BACKGROUND OF THE INVENTION

Board mounted right angle connectors of the type having contact leads that interferingly engage plated through holes in a circuit board, typically are assembled to the board by means of special tooling. The connector is positioned so that its contact leads are in alignment with their respective holes and the tooling is positioned so that it is in abutting engagement with shoulders or other abutting surfaces of the contacts. The tooling is then made to move toward the surface of the circuit board, forcing the contact leads into the holes until the connector is fully seated against the board. Such a connector and tooling arrangement is disclosed in U.S. Pat. No. 4,550,962, which issued Nov. 5, 1985 to Czeschka. The '962 patent teaches a connector having a two part housing and contact leads that exit the rear of the first part of the connector's housing and bend at a right angle toward the circuit board. Each contact lead has two abutting ears that extend from opposite sides thereof and a tail that is an interference fit with its respective hole in the circuit board. The insertion tooling has abutting surfaces that engage the ears of each contact lead and force their tails into their respective holes. A second part of the housing is then attached to the connector to cover the exposed leads. This connector has the disadvantage of having a separate cover housing that must be assembled by the user and requires specialized tooling to effect the insertion. Another connector having a two part housing that does not require specialized tooling is disclosed in U.S. Pat. No. 5,252,080 which issued Oct. 12, 1993 to Pesson. The '080 patent teaches a first connector housing having contact leads extending therefrom that are bent to a right angle and terminate in tails that are an interference fit with their respective circuit board holes. A second connector housing having channels therein that closely conform to the outer shape of the leads is attached to the first housing with the leads in their respective channels. The tails of the connector are inserted into the circuit board holes by means of a flat surface tool that engages a top surface of the second housing, forcing it toward the circuit board. The channels of the second housing back up the leads so that the tails are forced into their respective holes. This connector utilizes a two part housing that must be assembled after the contacts are inserted into cavities in one of the parts, which adds to the cost of manufacturing the connector. Another connector of interest utilizes a two part housing and is disclosed in U.S. Pat. No. 5,199,886 which issued Apr. 6, 1993 to Patterson. The bodies of the connector contacts are vertically disposed, with respect to the direction of insertion of the contact leads, that is, the width of the contact from one edge to the other edge is arranged vertically within the housing. Since the contacts are arranged on their edges within the housing, the overall height of the housing is directly related to the edge to edge width of the contacts. When dealing with contacts that must carry power, this edge to edge width is substantial, therefore, the height of the connector is substantially increased.

What is needed is a connector having a one piece housing wherein the contacts are arranged with their bodies horizontal to minimize connector height and which can easily be assembled to a circuit board without specialized tooling.

SUMMARY OF THE INVENTION

An electrical connector is disclosed for mounting to a mounting surface of a circuit board and being electrically interconnected to circuitry on the circuit board. An insulating housing is provided having a top surface and a bottom surface defining a plane substantially parallel to the top surface. The bottom surface is adapted to be mounted to the mounting surface of the circuit board. The housing has a plurality of spaced cavities formed therein stacked vertically between the top and bottom surfaces and separated by relatively thin walls so that each cavity has an upper wall and a lower wall. A plurality of contacts are arranged, one in each respective cavity. Each contact has a body, a contact portion extending from an end of the body, and a lead extending from an opposite end of the body at right angles to the plane and joined to the body at a bend. A portion of the body adjacent the bend is in engagement with the upper wall of its respective cavity. Some of the contacts, each have a support means extending from its body into engagement with the lower wall of its respective cavity for providing a vertical bearing structure between the upper and lower walls. The support means is arranged so that a longitudinal axis of each lead extends through the lower wall, support means, and upper wall of each cavity vertically above thereby defining a vertical bearing structure between the top surface and each lead for inserting the leads into engagement with the circuit board.

DESCRIPTION OF THE PREFERRED EMBODIMENT

Figure 5:
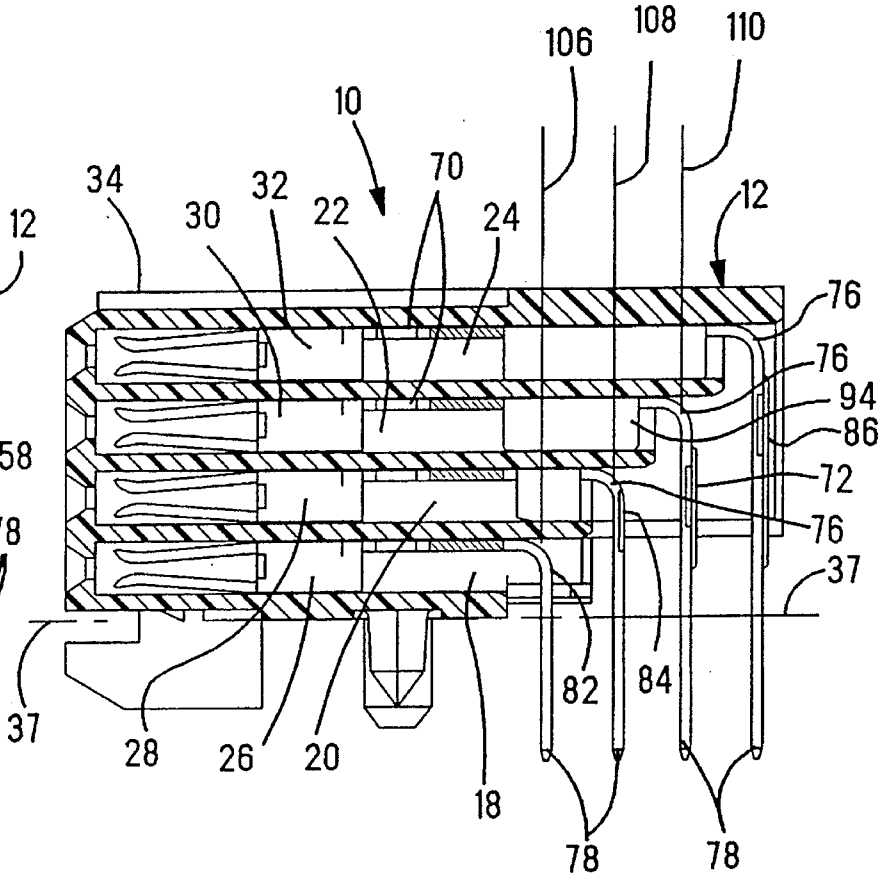
FIG. 5 is a cross-sectional view taken along the lines 5—5 in FIG. 2.
Figure 4:
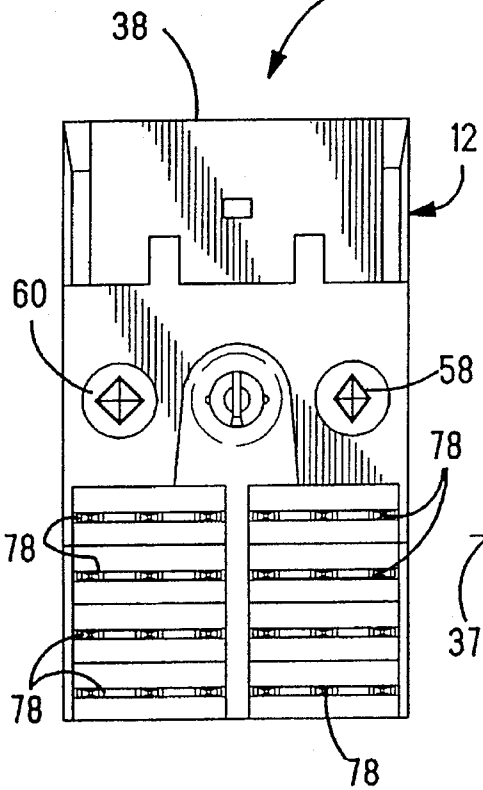

There is shown in FIGS. 1 through 6 an electrical connector 10 having a one piece insulating housing 12. The housing 12 includes a plurality of cavities containing contacts. The cavities are arranged in two side by side vertical stacks 14 and 16, each having contact receiving cavities 18, 20, 22, and 24. Each cavity 18, 20, 22, and 24 includes a receptacle power contact 26, 28, 30, and 32, respectively, as best seen in FIG. 5.

Figure 9:
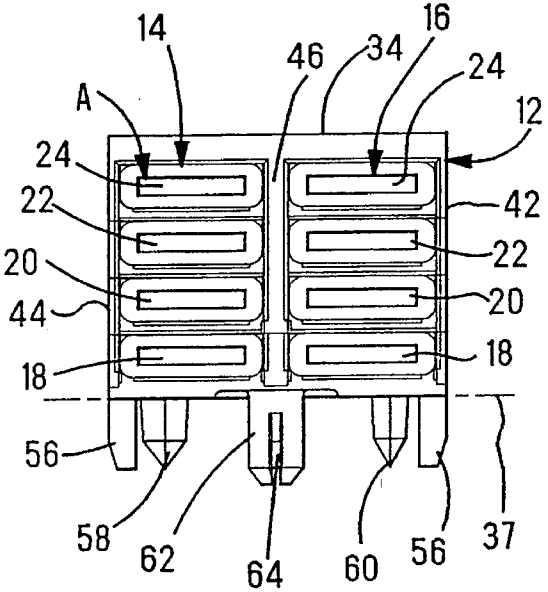
FIGS. 7, 8, 9, and 10 are side, front, back, and top views, respectively, of the connector housing shown in FIG. 1.
Figure 7:
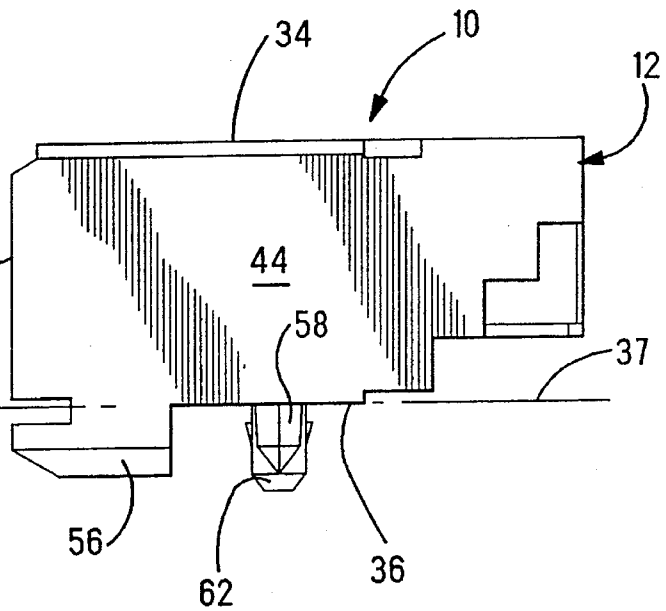
Figure 8:
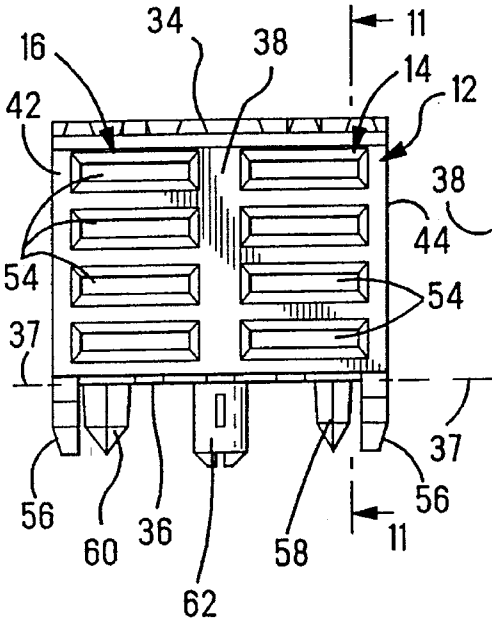
Figure 10:
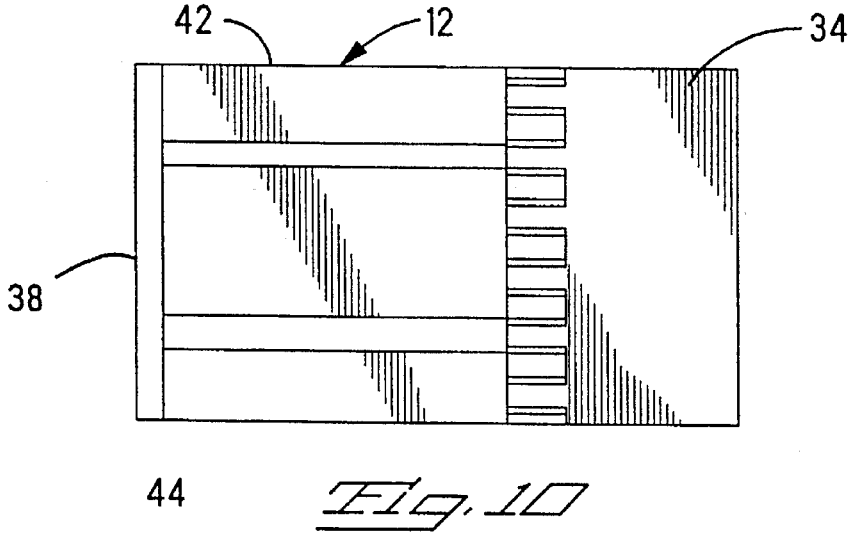
Figure 11:
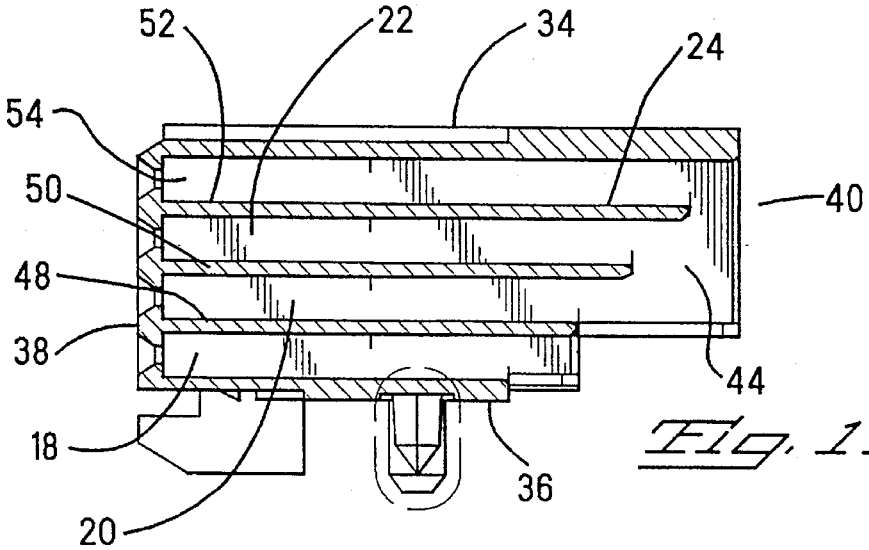
FIG. 11 is a cross-sectional view taken along the lines 11—11 in FIG. 8.
Figure 12:
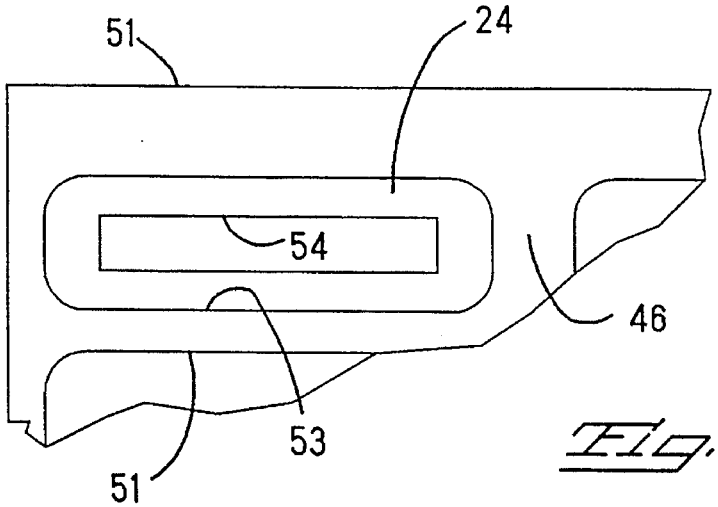
FIG. 12 is an enlarged view of a portion of FIG. 9 indicated at A.

The connector housing 12, as shown in FIGS. 7 through 11, includes a substantially flat top surface 34 and a substantially flat bottom surface 36. The bottom surface 36 defines a plane 37 and is intended to be mounted to a flat mounting surface of a circuit board, as will be explained below. Each of the contact receiving cavities 18 through 24 is rectangular in cross section and begins at a front wall 38 and extends to an open back 40 of the housing 12 so that the cavities are mutually parallel and parallel to the bottom surface 36 and plane 37. The two stacks 14 and 16 of cavities are arranged side by side and substantially perpendicular to the plane 37, as best seen in FIGS. 8 and 9. The housing includes two outside walls 42 and 44 and a center wall 46 separating the two stacks 14 and 16 that extends from the front wall 38 to the open end 40. The cavities 18 through 24 are separated by relatively thin walls 48, 50, and 52, as best seen in FIG. 11, thereby forming upper and lower walls 51 and 53, respectively in each cavity, as best seen in FIGS. 9 and 12. Each of the cavities 18 through 24 has a rectangular opening 54 through the front wall 38 that is centered in the cavity for receiving a pin contact from a mating connector. A pair of guide rails 56 extend below the bottom surface adjacent the front wall 38 for being guided into a mating connector. Two spaced locating pins 58 and 60 extend from the bottom surface 36 and are sized to slip fit into locating holes in the circuit board. These accurately position the connector housing with respect to the circuit board and prevent side to side movement thereof. A center pin 62 extends downwardly from the bottom surface 36, between the pins 58 and 60, and is bifurcated by a slot 64 so that the pin is somewhat resilient. The pin 62 is an interference fit with a hole in the circuit board and serves to lock the connector 10 onto the circuit board.

Figure 13:
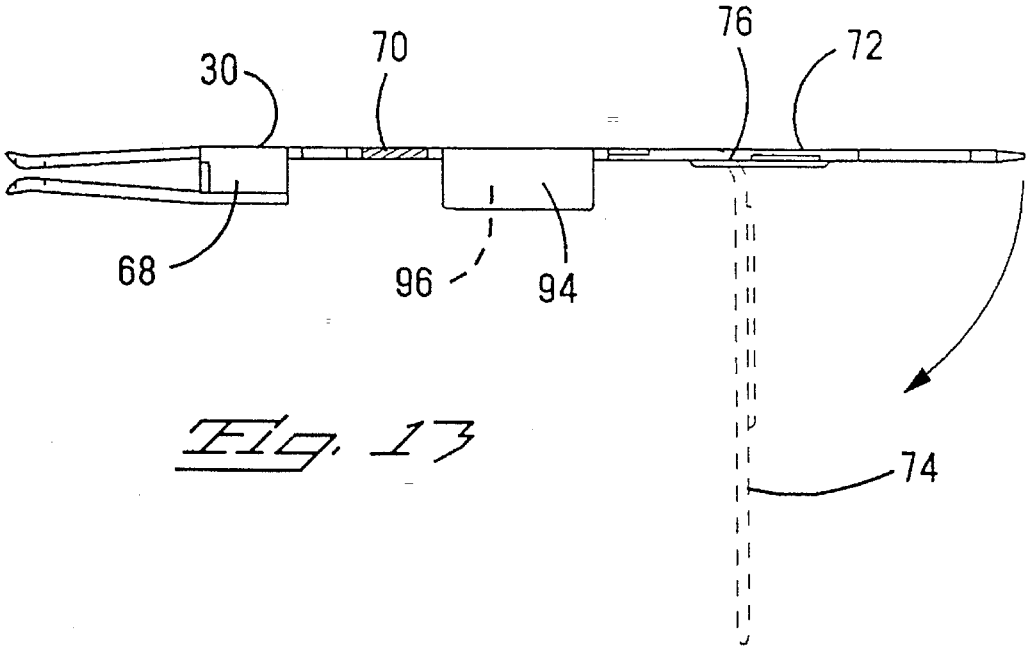
FIGS. 13 and 14 are side and plan views, respectively, of a contact shown in FIG. 5.
Figure 14:
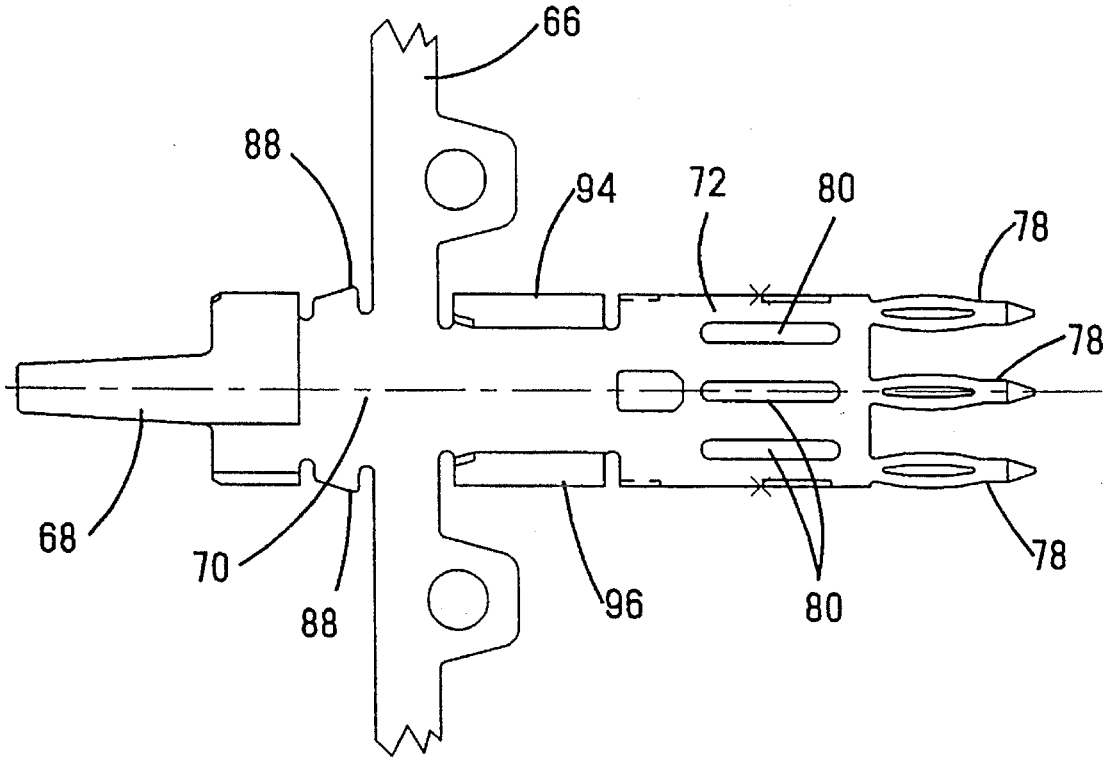

The contacts 26, 28, 30, and 32 are similar in structure, therefore, only the contact 30 is shown in FIGS. 13 and 14 and described, however, any differences between the contacts are also described. The contact 30 is stamped and formed from strip sheet stock and includes a carrier strip 66, in the usual manner, and has a receptacle contact portion 68 for mating with a pin contact, not shown. The contact 30 is made of any suitable contact material and includes a body 70 that is relatively flat and extends from the contact portion 68 to a transition member (72). The edge to edge width of the body 70 is chosen as a function of the power carrying capability required of the contact. In the present example, the contacts 26 through 32 each have a body 70 that is about 0.194 inch wide and a stock thickness of about 0.012 inch, thereby providing a current carrying capacity of about 5 amperes. The transition member (72) is shown in FIGS. 13 and 14 in its flat pattern prior to bending, in solid lines, and after bending in phantom lines at 74. After bending, the transition member (72) joins the body 70 at a bend 76 and forms a right angle to the body. Three tails 78 extend from the transition member (72) and are shaped to be an interference fit with plated through holes in the circuit board, not shown. Three stiffener ribs 80 are formed in the transition member (72) to provide sufficient strength to withstand the insertion force necessary to insert the tails 78 into their respective holes in the circuit board. The length of the transition member (72) will vary among the contacts 26, 28, 30, and 32 and is a function of their respective cavity 18 through 24. As best seen in FIG. 5, the contacts 26 and 28 have transition members 82 and 84, respectively, that are relatively shorter than the transition member (72) while the contact 32 has a transition member 86 that is substantially longer. The transition members 72, 82, 84, and 86 terminate just short of the plane 37 and their tails 78 extend through the plane. A pair of barbs 88 extend laterally from each side of the body 70 for securing the contact within the housing 12.

Figure 2:
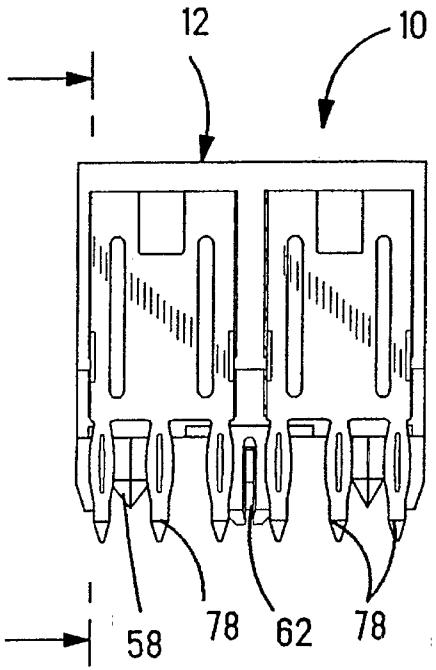
FIGS. 1, 2, 3, and 4 are side, back, front, and bottom views, respectively, of a connector incorporating the teachings of the present invention.
Figure 1:
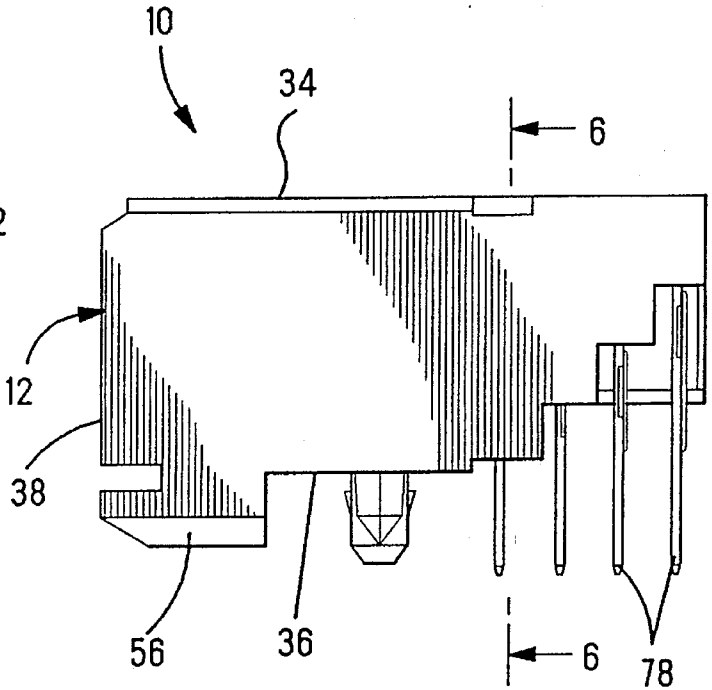
Figure 3:
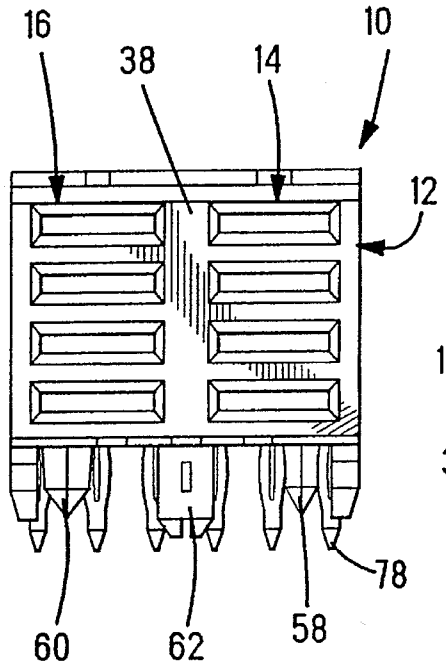
Figure 6:
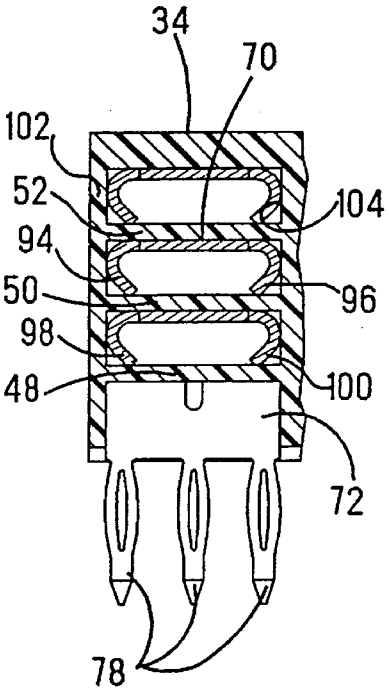
FIG. 6 is a cross-sectional view taken along the lines 6—6 in FIG. 1.

As shown in FIGS. 13 and 14, the contact 30 includes a pair of opposed support members 94 and 96 extending from opposite edges of the body 70. As best seen in FIG. 6, the support members 94 and 96 are bent downwardly to form a C-shape with the body 70. The depths of the support members 94 and 96, about 0.060 inch in the present example, are chosen so that their lower edges engage the lower wall 53 and the upper surface of the body 70 engages the upper wall 51, that is, the body 70 and support members 94 and 96 are a close fit within the cavity 22. The lower edges of the support members 94 and 96 are radiused to prevent damage to the lower wall 53. Additionally, the lower edges may be rolled over to form a box-shaped structure, however, it may be more difficult to hold tolerances during manufacturing and the structure would not be as strong as the C-shaped structure. Note that the distance between the upper and lower walls 51 and 53, respectively, of the cavities, about 0.062 inch, is substantially greater than the thickness of the body 70 of the contacts. As best seen in FIG. 5, the tails 78 of the contacts 26, 28, 30 and 32 are spaced apart so that they conform to the spacing of rows of holes in the circuit board. The contact 28 has a pair of support members 98 and 100 having a length less than that of the support members 94 and 96, while the contact 32 has a pair of support members 102 and 104 having a length that is greater. These lengths are selected so that the support members 98 and 100 are vertically above the bend 76 and centerline 106 of the tail 78 of the contact 26; the support members 94 and 96 are vertically above the support members 98 and 100, the bend 76 and centerline 108 of the tail 78 of the contact 28; and the support members 102 and 104 are vertically above the support members 94 and 96, the bend 76 and centerline 110 of the tail 78 of the contact 30. The support members of each of the contacts begin at a vertical line that is to the left of the tangent of the bend 76 of the contact 26 and extend rightwardly, as viewed in FIGS. 5 and 15, past the centerlines 106, 108, and 110 of the contacts vertically below them. In this way a vertical bearing structure is established for each tail 78 of each contact from the tail 78 to the top surface 36 of the housing 12. For example, a bearing structure extends from the tail 78 and its bend 76 of the contact 26, somewhat along the centerline 106, through the thin wall 48, the support members 98 and 100, the thin wall 50, the support members 94 and 96, the thin wall 52, the support members 102 and 104, and finally the upper wall 51 of the top most cavity 24 to the top surface 34. Similarly, vertical bearing structures extend from the tails 78 of the contacts 28, 30, and 32 to the top surface 34. These vertical bearing structures effectively transfer an insertion force that is vertically applied to the top surface 34 of the housing 12 to each of the tails 78 of the contacts 26 through 32.

Figures 15, 16, 17:
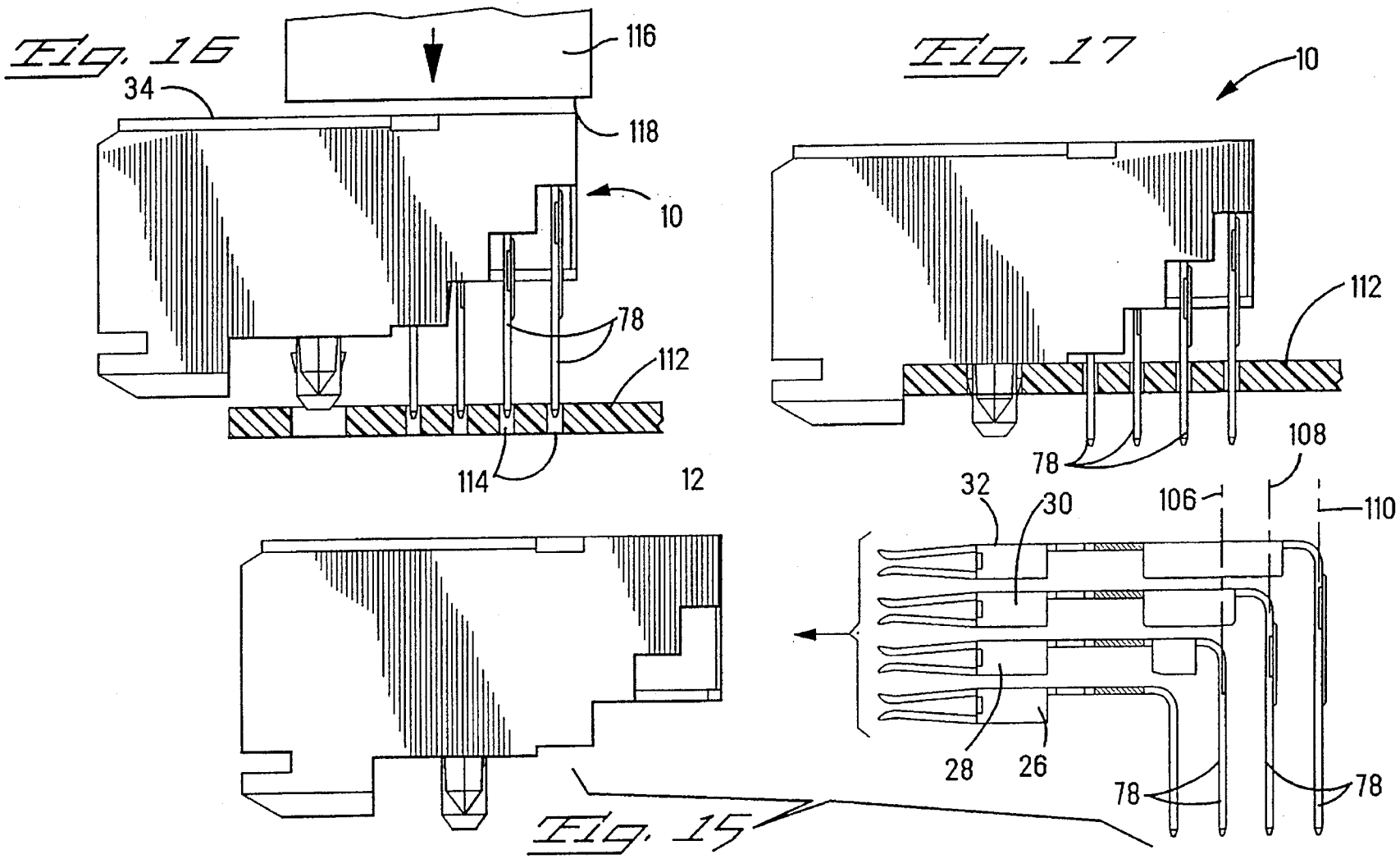
FIG. 15 is a side view of the connector housing of FIG. 1 showing the contacts prior to insertion into the housing.
FIGS. 16 and 17 show the connector of FIG. 1 in various stages of assembly to a circuit board.

As shown in FIG. 15, the contacts 26 through 32 are arranged in an array, aligned with their respective cavities 18 through 24, and inserted into their respective cavities to the positions shown in FIG. 5. The cavities are sized so that the contact portions 68 will slide freely through the cavities to their final positions where the barbs 88 dig into a narrowed portion of the cavities and secure the contacts in place. As shown in FIGS. 16 and 17, the connector 10 is assembled to a circuit board 112 by positioning the connector so that the tails 78 are vertically aligned with plated through holes 114 in the circuit board that are interconnected to circuitry thereon. An insertion tool 116 having a flat surface 118 is positioned directly above the connector 10 and lowered so that the flat surface 118 engages the top surface 34 of the connector. The tool 116 is further lowered so that it applies a sufficient force to the top surface 34, which is transferred to the tails 78 by means of the bearing structure described above, until the tails 78 are fully inserted into their respective holes 114. Concurrently, the pins 58, 60, and 62 engage respective holes in the circuit board, as described above, and the center pin 62, being in interfering engagement with its hole, secures the connector to the circuit board.

While the contacts 26 through 32 of the connector 10 are power contacts, in the present example, the teachings of the present invention may be advantageously utilized with connectors having only signal contacts or a combination of power and signal contacts. Additionally, while a connector having two side by side stacks 14 and 16 of cavities containing contacts is disclosed, the teachings of the present invention may be advantageously applied to connectors having any number of such stacks.

An important advantage of the present invention is that a one piece housing is utilized, thereby reducing the number of parts and the cost of manufacturing the connector. Additionally, the connector is assembled to the circuit board so that the contact tails are in interfering engagement with their respective plated holes by means of a simple tool having a flat bearing surface, no special tooling being required. A further advantage is that the horizontal orientation of the contact bodies results in a relatively low profile connector that accommodates power contacts.

We claim:

1. An electrical connector for mounting to a mounting surface of a circuit board and being electrically interconnected to circuitry on said circuit board, said connector comprising:

(a) an insulating housing having a top surface and a bottom surface defining a plane substantially parallel to said top surface, said bottom surface adapted to be mounted to said mounting surface of said circuit board, said housing having a plurality of spaced cavities formed therein stacked vertically between said top and bottom surfaces and separated by relatively thin walls so that each cavity has an upper wall and a lower wall;

(b) a plurality of contacts, one of which is in each respective said cavity, each said contact having a body, a contact portion extending from an end of said body, and a transition member extending from an opposite end of said body at right angles to said plane and joined to said body at a bend, a portion of said body at said bend being in engagement with said upper wall of its respective cavity, wherein some of said contacts, have a support means extending from its body into engagement with said lower wall of its respective cavity for providing a vertical bearing structure between said upper and lower walls, said support means arranged so that a longitudinal axis of each said transition member extends through a respective said lower wall, support means, and upper wall of each cavity vertically above thereby defining a vertical bearing structure between said top surface and each said transition member for inserting said transition members into engagement with said circuit board.

2. The connector according to claim 1 wherein said body of each said contact is substantially flat and parallel to said plane.

3. The connector according to claim 1 wherein said support means comprises two members extending from opposite sides of said body into said engagement with said lower wall of its respective said cavity.

4. The connector according to claim 1 wherein said support means of each said contact is vertically above all transition members of contacts in cavities vertically therebelow.

5. The connector according to claim 1 wherein each said transition member comprises a shank extending from said bend and terminating in at least one solder tail adapted to extend into and be in interfering engagement with a hole in said circuit board.

6. The connector according to claim 5 wherein each said shank of some of said contacts includes a stiffening rib formed therein, said rib being vertically disposed with respect to said plane.

7. The connector according to claim 6 wherein said hole in said circuit board has an electrically conductive surface interconnected with circuitry on said circuit board and said solder tail is adapted to be in electrical engagement with said conductive surface when in said hole.

8. An electrical connector assembly adapted for mounting to a major surface of a circuit board having transition member receiving apertures formed therein, comprising:

(a) an insulating housing having a plurality of vertically stacked cavities arranged between said top and bottom surfaces, said bottom surface defining a plane that is coplanar with said major surface of said circuit board;

(b) a plurality of contacts, one of which is in each respective cavity, each said contact having a body, a contact portion extending from an end of said body, and a transition member extending from an opposite end of said body at right angles to said plane and joined to said body at a bend, a portion of said transition member adapted to be an interference fit with said transition member receiving holes, a portion of said body at said bend being in engagement with an upper wall of its respective cavity, wherein some of said contacts, have a support means extending from its body into engagement with a lower wall, opposite said upper wall, of its respective cavity, for providing an insertion force transmitting structure between said upper and lower walls, said contacts being adapted for said mounting by inserting said portions of said transition members in said transition member receiving holes through the application of a downward insertion force to said top surface of said housing for transmitting said insertion force through said housing and said support means to said contact transition members through the engagement of said support means and said lower walls, whereby, upon positioning said connector so that said portions of said transition members are partially inserted into their respective transition member receiving holes in said circuit board, and upon applying an insertion force to said top surface, said insertion force is transmitted through said housing and through said support means of respective contacts to said transition members and said portions of said transition members will be driven into their respective transition member receiving holes.

9. The connector according to claim 8 wherein said body of each said contact is substantially flat and parallel to said plane.

10. The connector according to claim 8 wherein said support means comprises two members extending from opposite sides of said body into engagement with a lower wall of its respective said cavity.

11. The connector according to claim 8 wherein said support means of each said contact is vertically above all transition members of contacts in cavities vertically therebelow.

12. The connector according to claim 8 wherein each said portion of said transition member includes at least one solder tail extending therefrom adapted to extend into a said hole in said circuit board.

13. The connector according to claim 12 wherein each said transition member of some of said contacts includes a stiffening rib formed therein, said rib being vertically disposed with respect to said plane.

14. The connector according to claim 13 wherein said hole in said circuit board has an electrically conductive surface interconnected with circuitry on said circuit board and said solder tail is adapted to be an interference fit with said hole and in electrical engagement with said conductive surface when said solder tail is in said hole.

* * * * *